US007253565B2

(12) United States Patent
Kang et al.

(10) Patent No.: US 7,253,565 B2
(45) Date of Patent: Aug. 7, 2007

(54) APPARATUS FOR SUPPLYING POWER, BACKLIGHT ASSEMBLY AND LIQUID CRYSTAL DISPLAY APPARATUS HAVING THE SAME

(75) Inventors: Moon-Shik Kang, Seongnam-si (KR); Joon-Hee Kim, Daejeon (KR); Hyeong-Suk Yoo, Seongnam-si (KR)

(73) Assignees: Samsung Electronics Co., Ltd. (KR); Wooyoung Co., Ltd. (KR)

( * ) Notice: Subject to any disclaimer, the term of this patent is extended or adjusted under 35 U.S.C. 154(b) by 15 days.

(21) Appl. No.: 10/525,463

(22) PCT Filed: Aug. 22, 2003

(86) PCT No.: PCT/KR03/01695

§ 371 (c)(1),
(2), (4) Date: Feb. 24, 2005

(87) PCT Pub. No.: WO2004/019312

PCT Pub. Date: Mar. 4, 2004

(65) Prior Publication Data

US 2005/0242789 A1 Nov. 3, 2005

(30) Foreign Application Priority Data

Aug. 26, 2002 (KR) ..... 2002-50566

(51) Int. Cl.
*H05B 41/16* (2006.01)
*H05B 41/24* (2006.01)
*G05F 1/613* (2006.01)
*G05F 3/16* (2006.01)

(52) U.S. Cl. ..... 315/276; 315/291; 315/167; 323/224

(58) Field of Classification Search ..... 315/276, 315/291, 167; 323/224
See application file for complete search history.

(56) References Cited

U.S. PATENT DOCUMENTS 4,933,605 A 6/1990 Quazi et al. ..... 315/224

(Continued)

FOREIGN PATENT DOCUMENTS

GB 2 316 246 A 2/1998

(Continued)

OTHER PUBLICATIONS

PCT International Search Report; International application No. PCT/KR2003/001695; International filing date: Aug. 22, 2003; Date of Mailing: Jul. 12, 2004.

(Continued)

*Primary Examiner*—Don Wong
*Assistant Examiner*—Marie Antoinette Cabucos
(74) *Attorney, Agent, or Firm*—Cantor Colburn LLP

(57) ABSTRACT

Disclosed are a power supplying apparatus, a backlight assembly and an LCD apparatus having the same. A control section outputs a switching signal so as to control an output of a constant current supplied to a lamp unit in response to on and/or off signals and a dimming signal and a switching section controls an output of a direct current voltage source in response to the switching signal. A power outputting section provides an alternating current voltage source having a constant voltage to the lamp unit. A sensing section senses variation of a power supplied to the lamp unit and a detecting section compares a sensing signal with a predetermined reference signal to output a detecting signal to the control section, thereby maintaining the constant current to be supplied to the lamp unit. Accordingly, the LCD apparatus may prevent deterioration of an image and damage of circuit thereof.

17 Claims, 6 Drawing Sheets

U.S. PATENT DOCUMENTS

| | | | | |
|---|---|---|---|---|
| 5,629,588 | A * | 5/1997 | Oda et al. | 315/308 |
| 5,663,613 | A * | 9/1997 | Yamashita et al. | 315/308 |
| 5,939,830 | A * | 8/1999 | Praiswater | 315/169.3 |
| 6,051,940 | A * | 4/2000 | Arun | 315/307 |
| 6,191,539 | B1 | 2/2001 | Green | 315/249 |
| 6,307,765 | B1 * | 10/2001 | Choi | 363/134 |
| 6,693,396 | B1 * | 2/2004 | Hsu | 315/291 |
| 2002/0003525 | A1 | 1/2002 | Hwang | 345/102 |
| 2002/0121865 | A1 * | 9/2002 | Nakatsuka et al. | 315/209 PZ |
| 2003/0151931 | A1 * | 8/2003 | Kohno | 363/22 |

FOREIGN PATENT DOCUMENTS

| | | |
|---|---|---|
| JP | 9-73989 | 3/1997 |

OTHER PUBLICATIONS

PCT Preliminary Examination Report; International application No. PCT/KR2003/001695; International filing date: Aug. 22, 2003; Date of Completion: Nov. 22, 2004.

* cited by examiner

APPARATUS FOR SUPPLYING POWER, BACKLIGHT ASSEMBLY AND LIQUID CRYSTAL DISPLAY APPARATUS HAVING THE SAME

TECHNICAL FIELD

The present invention relates to an apparatus for supplying power, a backlight assembly and an LCD (Liquid Crystal Display) apparatus, and more particularly to an apparatus for sensing a power supplied to a lamp, a backlight assembly and an LCD having the same.

BACKGROUND ART

An LCD apparatus is a non-emissive display apparatus receiving light from an external to display an image, so that the LCD apparatus separately needs a backlight assembly that supplies the light to the LCD apparatus. The backlight assembly generally requires characteristics such as a high brightness, a high light efficiency, a uniform brightness, a long life, a light weight, a low cost or the like. For example, a backlight assembly used to an LCD for a laptop computer needs a lamp having the high light efficiency and the long life so as to reduce a power consumption thereof and a backlight assembly used to an LCD for a monitor or a television set needs a lamp having the high brightness.

Particularly, the LCD for the television set demands the higher brightness and longer life than that of the LCD for the laptop computer. However, a CCFL (Cold Cathode Fluorescent Lamp) is not appropriate to satisfy the demands of the LCD for the television set, so that an external electrode fluorescent lamp has been developed as a substitute for the CCFL. The external electrode fluorescent lamp is classified into an EEFL (External Electrode Fluorescent Lamp) having an external electrode disposed at both outer end portions of the lamp and an EIFL (External Internal Fluorescent Lamp) having an external electrode disposed at one outer end portion.

Recently, a parallel driving method that drives a plurality of lamps using only one inverter has been developed. When driving the lamps in parallel, a feedback circuit is needed to prevent-an image from being deteriorated and a circuit of the LCD apparatus from being damaged.

DISCLOSURE OF THE INVENTION

The present invention provides an apparatus for supplying power to a lamp in stable.

The present invention also provides a backlight assembly having the power supplying apparatus.

The present invention also provides an LCD apparatus having the backlight assembly.

In one aspect of the invention, there is provided an apparatus for supplying power comprising: a switching section for controlling an output of a direct current voltage source inputted from external; a power transforming section for converting the direct current voltage source from the switching section into an alternating current voltage source and transforming the alternating current voltage source; a control section for outputting a switching signal so as to control an output of a constant current supplied to a lamp unit in response to a dimming signal inputted from an external; a sensing section for sensing variation of a power supplied to the lamp unit; and a detecting section for comparing a sensing signal provided from the sensing section with a predetermined reference signal to output a detecting signal to the control section, thereby maintaining the constant current to be supplied to the lamp unit.

In another aspect, there is provided a backlight assembly comprising: a lamp driving section for converting a direct current voltage source inputted from an external into an alternating current voltage source and transforming the converted alternating current voltage source; a light emitting section for emitting a light in response to the transformed alternating current voltage source, the light emitting section having a lamp unit that receives a high voltage of an alternating current voltage source through at least one end terminal; and a light control section for increasing a brightness of the light, wherein the lamp driving section comprises: a control section for outputting a switching signal so as to control an output of a constant current supplied to the lamp unit in response to a dimming signal inputted from an external, the control section being operated in response to on and/or off signals from the external; a switching section for controlling an output of a direct current voltage source in response to the switching signal; a power outputting section for converting the direct current voltage source from the switching section into the alternating current voltage source, transforming the converted alternating current voltage source into an alternating current voltage source having a constant voltage to provide the alternating current voltage source having the constant voltage to the lamp unit; a sensing section for sensing variation of a power supplied to the lamp unit; and a detecting section for comparing a sensing signal provided from the sensing section with a predetermined reference signal to output a detecting signal to the control section, thereby maintaining the constant current to be supplied to the lamp unit.

In further aspect, there is provided an LCD apparatus comprising: a backlight assembly having a lamp driving section for converting a direct current voltage source inputted from an external into an alternating current voltage source and transforming the converted alternating current voltage source; a light emitting section for emitting a light in response to the transformed alternating current voltage source, the light emitting section having a lamp unit that a plurality of external electrode fluorescent lamps are connected to each other in parallel, each of the external electrode fluorescent lamps having at least one external electrode that receives a high voltage of an alternating current voltage source; and a light control section for increasing a brightness of the light provided from the light emitting section; and a display unit disposed on the light control section, for receiving the light from the light emitting section through the light control section and displaying an image, wherein the lamp driving section comprises: a control section for outputting a switching signal so as to control an output of a constant current supplied to the lamp unit in response to a dimming signal inputted from an external, the control section being operated in response to on and/or off signals from the external; a switching section for controlling an output of a direct current voltage source in response to the switching signal; a power outputting section for converting the direct current voltage source from the switching section into the alternating current voltage source, transforming the converted alternating current voltage source into an alternating current voltage source having a constant voltage to provide the alternating current voltage source having the constant voltage to the lamp unit; a sensing section for sensing variation of a power supplied to the lamp unit; and a detecting section for comparing a sensing signal provided from the sensing section with a predetermined reference signal to output a detecting signal to the control section, thereby maintaining the constant current to be supplied to the lamp unit.

According to the power supplying apparatus, backlight assembly and LCD apparatus, it is able to sense a level of the power applied to the lamp and monitor an operation stage of the lamp, thereby preventing an image from being deteriorated and a circuit of the LCD apparatus from being damaged

BRIEF DESCRIPTION OF THE DRAWINGS

The above and other advantages of the present invention will become readily apparent by reference to the following detailed description when considered in conjunction with the accompanying drawings wherein.

BEST MODE FOR CARRYING OUT THE INVENTION

Figure 1:
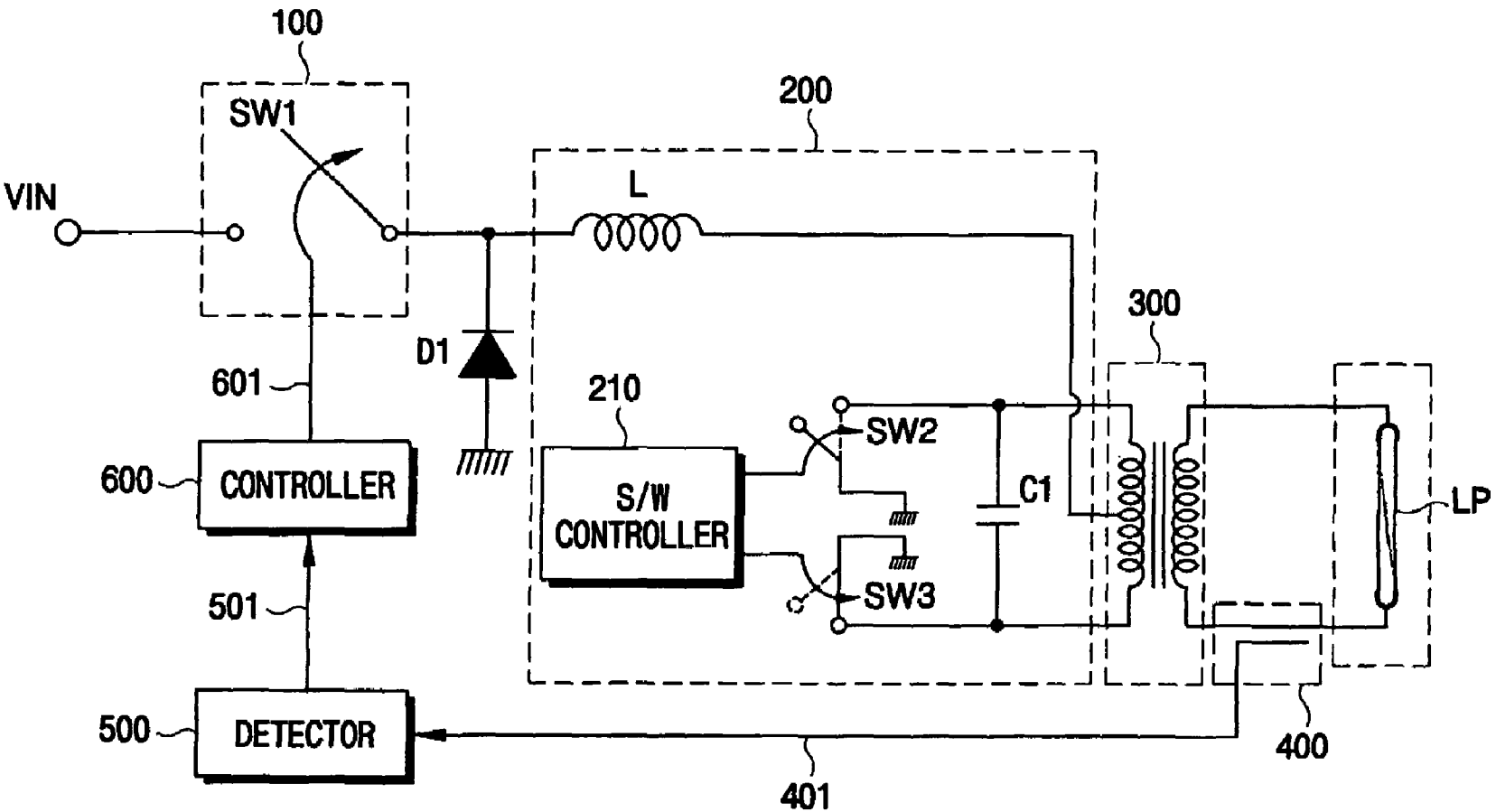
FIG. 1 is a circuit diagram showing a configuration of a lamp driving apparatus of a backlight assembly according to the present invention.

FIG. 1 is a circuit diagram showing a configuration of a lamp driving apparatus of a backlight assembly according to the present invention.

Referring to FIG. 1, the lamp driving apparatus includes a switching section 100 having a first switch SW1, a diode D1, an inverting section 200, a transforming section 300 (hereinafter, referred to as "transformer"), a sensing section 400, a detecting section 500 and a control section 600. The lamp driving apparatus converts a direct current voltage source (hereinafter, referred to as "DC voltage source") provided from an external into an alternating current voltage source voltage source (hereinafter, referred to as "AC voltage source") to provide the AC voltage source to a lamp LP. The inverting section 200 includes an inductor L, a capacitor C1, a second switch SW2, a third switch SW3 and a switch control section 210.

The switching section 100 is connected between a power supply (not shown) and the inductor L and the inductor L is connected to a central tap of the transformer 300. The inductor L intermits the DC voltage source VIN inputted from the power supply to provide a DC voltage source having a pulse shape to the inverting section 200 in response to a switching control of the control section 600. The DC voltage source is in a range of about 3 to about 30 volts. The first switch SW1 is one of an analog switch, a bipolar junction transistor BJT or a field effect transistor FET.

The diode D1 is connected between a first node, and a second node. The first node is disposed between the first switch SW1 and the inductor L and the second node is connected to a ground. A cathode of the diode D1 is connected to an output terminal of the switching section 100 and an anode is connected to the ground. The diode D1 blocks that a rush current generated from the inverting section 200 is applied to the switching section 100. The capacitor C1 is connected to the transformer 300 in parallel. The capacitor C1 includes a first node connected to the second switch SW2 and a second node connected to the third switch SW3 and the second and third switches SW2 and SW3 are connected to the ground, respectively.

The sensing section 400 senses a voltage level of a power applied to the lamp LP and provides the sensed voltage level to the detecting section 500. Also, the sensing section 400 may sense current and resistance variations at an output terminal of the transformer 300. The lamp LP may include one or more cold cathode fluorescent lamps (CCFL) or one or more external electrode fluorescent lamps.

In case of sensing a voltage variation of the output terminal of the transformer 300, the sensing section 400 for measuring an output voltage is disposed adjacent to a secondary winding of the transformer 300. When an electric field is generated between the sensing section 400 and the secondary winding, so that the sensing section 400 may sense the voltage variation of the output terminal from a current applied to the sensing section 400.

The sensing section 400 disposed adjacent to the secondary winding of the transformer 300 may flirter include a noise interception member to prevent an electrical noise component from being applied thereto. Also, the sensing section 400 may be shielded to prevent an EMI component from being thereto.

When driving a plurality of lamps connected to each other in parallel, the sensing section 400 may be disposed adjacent to one end terminal of each of the lamps, thereby sensing the voltage variation of the output terminal. The detecting section 500 may be used one or more numbers when a number of the sensing sections are in proportion to a number of the lamps.

In case of sensing a current variation of the output terminal, a photo diode that outputs a current in response to a light emitted from the lamp LP may be used. The sensed current signal that indicates the current variation value is converted into a voltage signal because the voltage signal is simpler than the current signal to use in a circuit diagram like the lamp driving apparatus.

The detecting section 500 compares the voltage level sensed by the sensing section 400 with a reference level to generate a detecting signal and provides the generated detecting signal to the control section 600.

The control section 600 is connected to the first switch SW1 and operated in response to on/off signal (not shown) provided from an external. The control section 600 outputs a switching signal 601 in response to a dimming signal (not shown) provided from the external so as to control an output of a constant current applied to the lamp LP.

When the first switch SW1 is closed (ON), the DC voltage source is applied to the inverting section 200 and the AC voltage source, for example a voltage having a sine wave appears in a load or the lamp LP. The current is provided from a power supply +V to the central tap of the transformer 300 through the inductor L. The switch control section 210 controls the second and third switches SW2 and SW3 to be turned on or off The second and third switches SW2 and SW3 are alternatively opened or closed to generate the AC waveform. Operating frequencies of the second and third switches SW2 and SW3 may be uniformly maintained, however, the operating frequencies are normally synchronized with a resonance frequency of a reactance component (that is, capacitor C1, transformer. 300) of a circuit representing the lamp driving apparatus.

When the operating frequencies of the second and third switches SW2 and SW3 are synchronized with the resonance frequency, the sine wave is outputted. The operating frequencies of the second and third switches SW2 and SW3 are tens of KHz. A first voltage of the first winding of the transformer 300 is amplified corresponding to a second voltage appeared in the secondary winding of the transformer 300 and a turn ratio of the transformer 300. The second voltage of the secondary winding of the transformer 300 has to exceed a strike voltage of the lamp LP.

The strike voltage of the lamp LP is under the influence of various parameters of the lamp LP such as a length, a diameter or the like. When the second voltage of the secondary winding of the transformer 300 exceeds the strike voltage of the lamp LP, the current is applied to the lamp LP to turn on the lamp LP. The current applied to the lamp LP may be adjusted in a desired level using a ballast inductor.

When the first switch SW1 is opened, the power is removed from the inverting section 200 to turn off the lamp LP. However, the current is returned from the power supply +V to the central tap of the transformer 300 through the inductor L and the diode D1 until an energy charged in the inductor L is disappeared. The first switch SW1 adjusts the output of the DC voltage source in response to the output from the control section 600 to control the power applied to the lamp LP. An illuminance of the lamp LP may be varied according to an input from an LCD device (not shown).

As aforementioned above, an antenna for sensing the voltage outputted from the transformer 300 is disposed adjacent to the output terminal of the transformer 300 connected to both end terminals of the lamp LP. Accordingly, it is able to know that the current is normally supplied to the lamp LP based on the sensed voltage value by the antenna.

Particularly, if the voltage value is not sensed by the antenna a while the power is supplied to the lamp through the input winding of the transformer 300, this means that the output winding of the transformer 300 is under a no-load state. That is, since the lamp LP is under a shut-down state, the power is not applied to the lamp LP anymore.

Also, when the voltage value sensed by the antenna is lower than a threshold voltage of the lamp LP, this means that several lamps of the plurality of lamps are under the shut-down state. It is able to reduce the pulse power applied to the inverting section 200 using the switching section 100.

Figure 2:
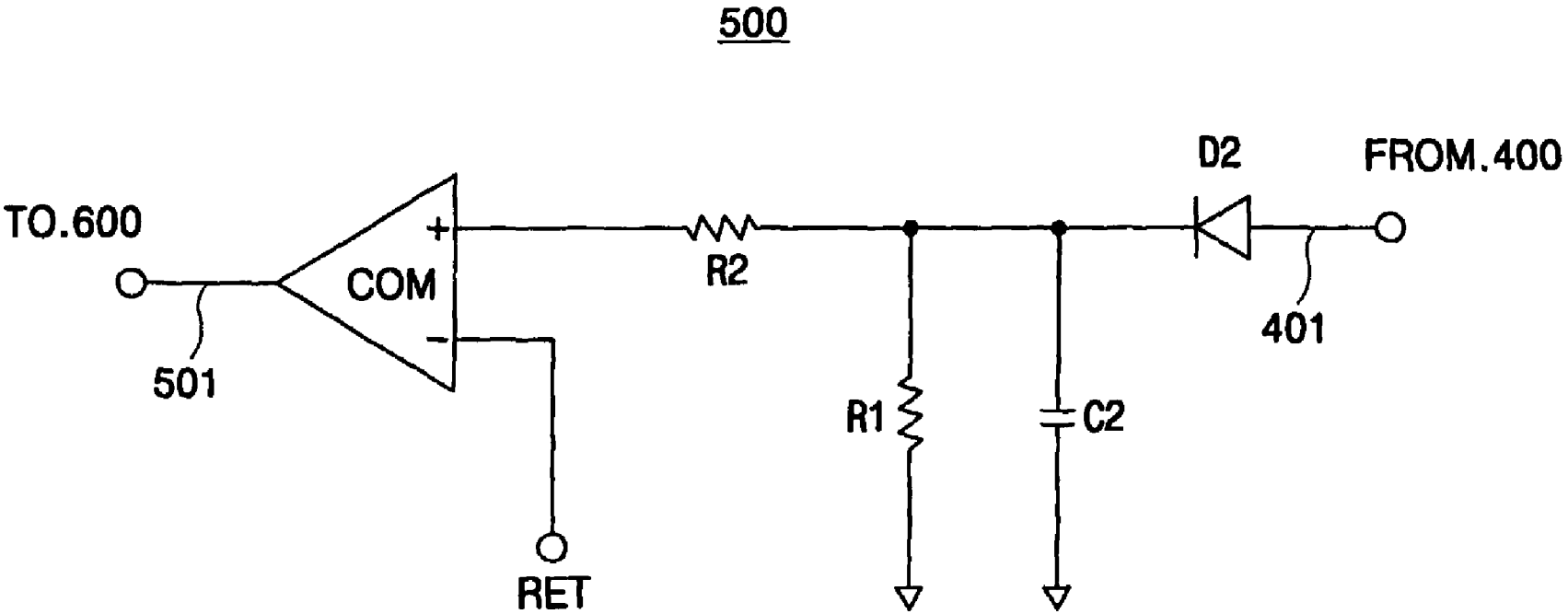
FIG. 2 is a circuit diagram showing the detecting section shown in FIG. 1.

FIG. 2 is a circuit diagram showing the detecting section shown in FIG. 1.

Referring to FIG. 2, the detecting section 500 includes a second diode D2, a second capacitor C2, a first resistor R1, a second resistor R2 and a comparator COM.

The signal 401 sensed by the antenna connected to the secondary winding of the transformer 300 has a level lowered by the second diode D2, the second capacitor C2 connected to the second diode D2 in parallel and the first and second resistors R1 and R2. The comparator COM receives the signal 401 inputted from the second resistor R2 through a first input terminal thereof and compares the signal 401 with a reference signal inputted through a second input terminal to output a detecting signal 501. The comparator COM provides the detecting signal 501 to the control section 600. The control section 600 controls on and off operations of the first switch SW1 to control the DC voltage source VIN in response to the detecting signal 501.

Figure 3:
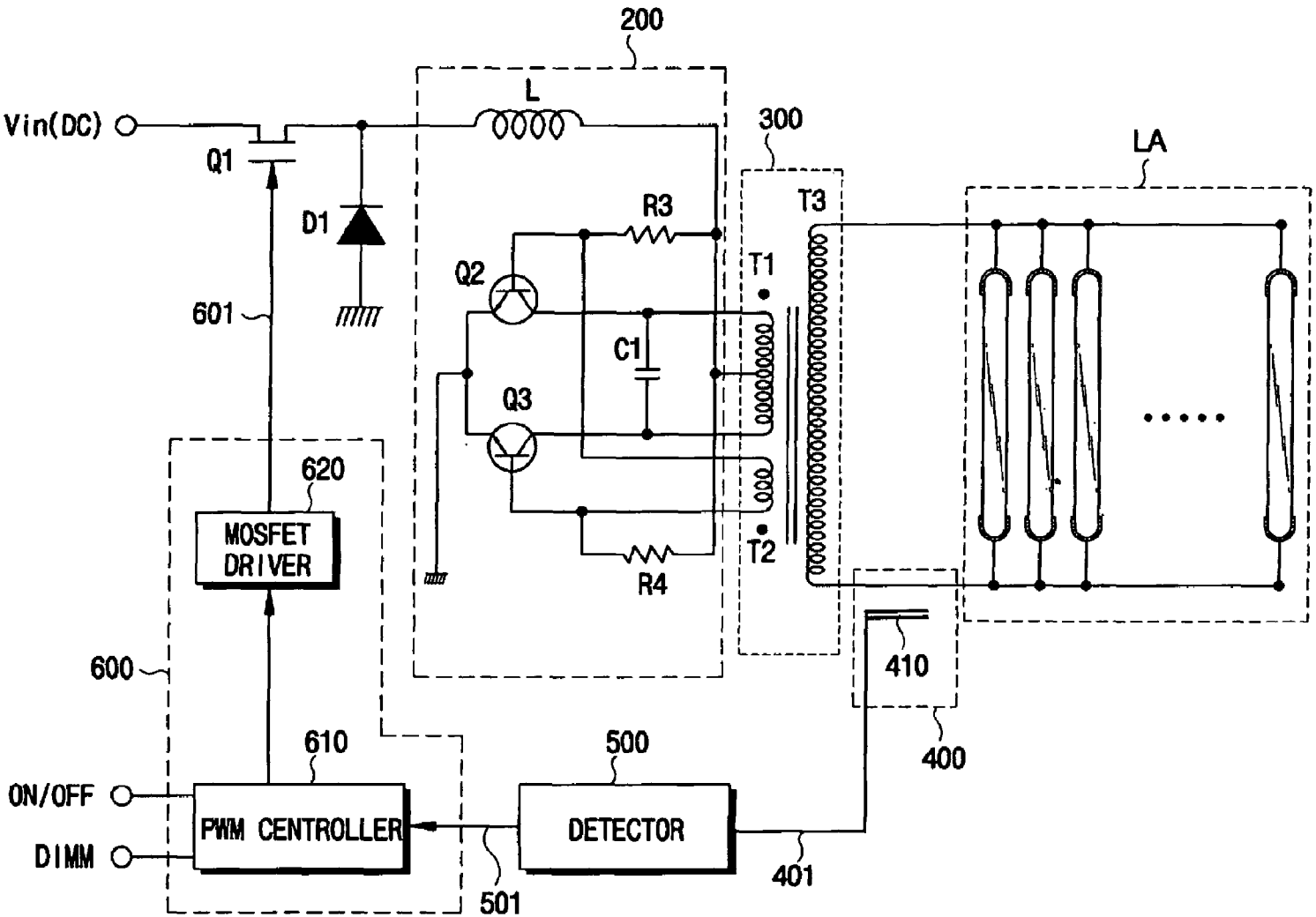
FIG. 3 is a circuit diagram showing a configuration of a lamp driving apparatus of a backlight assembly according to another embodiment the present invention.

FIG. 3 is a circuit diagram showing a configuration of a lamp driving apparatus of a backlight assembly according to another embodiment the present invention.

Referring to FIG. 3, the lamp driving apparatus includes a power transistor Q1, a diode D1, an inverting section 200, a transforming section 300 having a transformer, a sensing section 400 disposed adjacent to an output terminal of the transformer 300, a detecting section 500 and a control section 600. The lamp driving apparatus converts a DC voltage source inputted from an external into an AC voltage source and provides the AC voltage source to a lamp array LA having a plurality of external electrode fluorescent lamps (EEFL) connected to each other in parallel.

In FIG. 3, the EEFL having an external electrode disposed at both end portions of the lamp is described. However, an EIFL having an external electrode disposed on an outer surface of one end portion thereof and an internal electrode disposed on an inner surface of another end portion thereof may be applied to the lamp driving apparatus. Also, the lamp may include a ballast capacitor disposed at both end portions thereof.

The power transistor Q1 is turned on in response to a switching signal 601 inputted from the control section 600 through a gate terminal thereof to control an output of the DC voltage source from a source terminal to the inverting section 200 through a drain terminal thereof.

The diode D1 includes a cathode connected to the drain terminal of the power transistor Q1 and an anode connected to a ground to block a rush current from the inverting section 200.

The inverting section 200 connected between the power transistor Q1 and the transformer 300 includes an inductor L, a resonance capacitor C1, a third resistor R3, a fourth resistor R4, a first transistor Q2 and a second transistor Q3. The inverting section 200 converts the DC voltage source from the power transistor Q1 into a first AC voltage source and boosts the first AC voltage source to a second AC voltage source to provide the second AC voltage source to the transformer 300. In FIG. 3, the inverting section 200 is a resonant type Royer inverter.

Particularly, the inductor L receives the DC voltage source through a first terminal connected to the drain terminal of the power transistor Q1. The inductor L removes an impulse component included in the DC voltage source and outputs the DC voltage source. The inductor L is operated as a switching regulator that charges an energy and provides a counter-electromotive force to the diode D1 while the power transistor Q1 is turned off.

The transformer 300 includes a primary winding having a first coil T1 and a second coil T2 and a secondary winding having a third coil T3. The transformer 300 receives the AC voltage source applied to the first coil T1 through the inductor L of the inverting section 200 and provides the AC voltage source to the third coil T3 so as to change the AC voltage source to an AC voltage source having a high voltage level. The changed AC voltage source is applied to the lamp array LA through the third coil T3 of the transformer 300.

The first coil T1 receives the AC voltage source from the inductor L through the central tap. The second coil T2 alternatively turns on the first and second transistors Q2 and Q3 in response to the AC voltage source which is applied to the first coil T1.

The resonance capacitor C1 is connected between both terminals of the first coil T1 of the transformer 300 in parallel and operated as an LC resonance circuit with an inductance component of the first coil T1. The second coil T2 connected to an input terminal of the transformer 300 alternatively turns on the first and second transistors Q2 and Q3.

The first transistor Q2 includes a base terminal connected to the DC voltage source inputted through the third resistor R3 and a collector terminal connected to a node that a first terminal of the resonance capacitor C1 and the first coil T1 are connected in parallel so as to drive the transformer 300. The second transistor Q3 includes a base terminal connected to the DC voltage source inputted through the fourth resistor R4 and a collector terminal connected to a node that a second terminal of the resonance capacitor C1 and the first coil T1 are connected in parallel so as to drive the transformer 300. Emitter terminals of the first and second transistors Q2 and Q3 are commonly connected to each other.

The sensing section 400 includes an antenna 410 disposed adjacent to the output terminal, that is, a wire for supplying the power outputted from the third coil T3 to the lamp array LA of the transformer 300. The sensing section 400 senses a voltage of the wire and provides the sensed voltage to the detecting section 500 as shown in FIG. 2. That is, when the antenna 410 is disposed adjacent to the second coil T2 of the transformer 300, an electric field is generated between the second coil T2 and the wire connected to the output terminal of the second coil T2. Accordingly, the antenna 410 may sense the variation of the voltage applied to the lamp array LA.

Particularly, when an antenna 410 having a coil shape is disposed adjacent to the second coil T2, the second coil T2 and the antenna 410 is operated as a transformer, so that a current is generated in proportion to the voltage induced to the antenna 410.

The control section 600 includes a PWM (Pulse Width Modulation) controller 610 and a MOSFET (Metal Oxide Semiconductor Field Effect Transistor) driver 620. The control section 600 provides a switching signal for adjusting a level of the AC voltage source to the power transistor Q1 in response to a dimming signal from the external and the detecting signal 500 from the detecting section 500. The dimming signal having a digital value is generated when a user operates a key pad so as to adjust a brightness of the lamps. The detecting signal may be obtained by comparing the sensed signal from the output terminal of the transformer with the reference signal.

The MOSFET driver 620 amplifies a signal for adjusting a level of the AC voltage source provided from the PWM controller 610 and provides the amplified signal to the power transistor Q1. In general, the AC voltage source outputted from the PWM controller 610 has a level lower than that of an AC voltage source required to drive the power transistor Q1, so that the AC voltage source from the PWM controller 610 has to be amplified before applying to the power transistor Q1.

Hereinafter, the power outputting section having the inverting section 200 and the transformer 300 will be described.

The DC voltage source converted by the power transistor Q1 is applied to the base terminal of the first transistor Q2 through the third resistor R3 for supplying a driving current to the power transistor Q1. The first coil T1 having the central tap of the transformer 300 is connected between the collector terminals of the first and second transistors Q2 and Q3 in parallel and the resonance capacitor C1 is connected between the collector terminals of the first and second transistors Q2 and Q3 in parallel.

The DC voltage source is provided to the central tap of the transformer 300 through the inductor L having a choke coil for converting the current applied to the inverting section 200 into a constant current.

The third coil T3 of the transformer 300 has a lot of winding than that of the first coil T1. The plurality of lamps of the lamp array LA is connected to the third coil T3 of the transformer 300 in parallel and supplies a constant voltage to each fluorescent lamps. The constant voltage may have the boosted AC voltage source having levels of positive polarity and negative polarity equal to each other or the boosted AC voltage source having gaps between maximum level and minimum level equal to each other.

The second coil T2 is connected between the base terminal of the first transistor Q2 and the base terminal of the second transistor Q3 and the voltage excited by the second coil T2 is applied to the base terminals of the first and second transistors Q2 and Q3.

As shown in FIG. 3, the sensing section 400 includes one antenna 410 and the antenna 410 is connected to the second coil T2. However, the antenna 410 may be disposed corresponding to each of the external electrode fluorescent lamps. Also, the lamp driving apparatus may have one or more detecting section 500 in proportion to a number of the antenna 410.

Hereinafter, the inverting section 200 for converting the DC voltage source into the AC voltage source will be described.

When the converted DC voltage source is applied to the inverting section 200, the current is applied to the first coil T1 of the transformer 300 through the inductor L. Simultaneously, the pulse power is applied to the base terminals of the first and second transistors Q1 and Q2 via the third and fourth resistors R3 and R4, respectively. The resonance occurs by the primary winding of the transformer 300, that is the first coil T1 and the resonance capacitor C1. Accordingly, the boosted voltage according to a turn ratio between the first coil T1 and the third coil T3 is generated at both end terminals of the secondary winding of the transformer 300, that is the third coil T3. At this time, the current having a direction opposite to that of the current applied to the second coil T2 is applied to the first coil T1.

When the voltage is boosted by the turn ratio between the first coil T1 and the third coil T3 of the transformer 300, the high voltage waveform of which frequency and phase are synchronized to each other from the both end terminals of the third coil T3 of the transformer 300, thereby reducing flickers of the lamp array LA.

As aforementioned above, the EEFL having the external electrode disposed at both end portions of the lamp may be replaced with the EIFL having an external electrode disposed on an outer surface of one end portion thereof and an internal electrode disposed on an inner surface of another end portion thereof Also, the EEFL and EIFL may be applied to the lamp array LA with each other.

When the EEFLs and EIFLs, which are connected to each other in parallel, are applied to the lamp array LA and driven in a floating manner, the brightness level of the lamps may be easily controlled because the AC voltage source having the constant voltage is applied to the lamps in response to the dimming signal from the external.

Also, if one or more lamps among the plurality of the lamps of the lamp array LA connected to each other in parallel are in an abnormal state, the antenna connected to the third coil T3 may sense the abnormal state of the lamps. Accordingly, the control section 600 may control the DC voltage source inputted from the external to supply the constant current to the lamp array LA.

Hereinafter, an LCD apparatus having the backlight assembly will be described.

Figure 4:
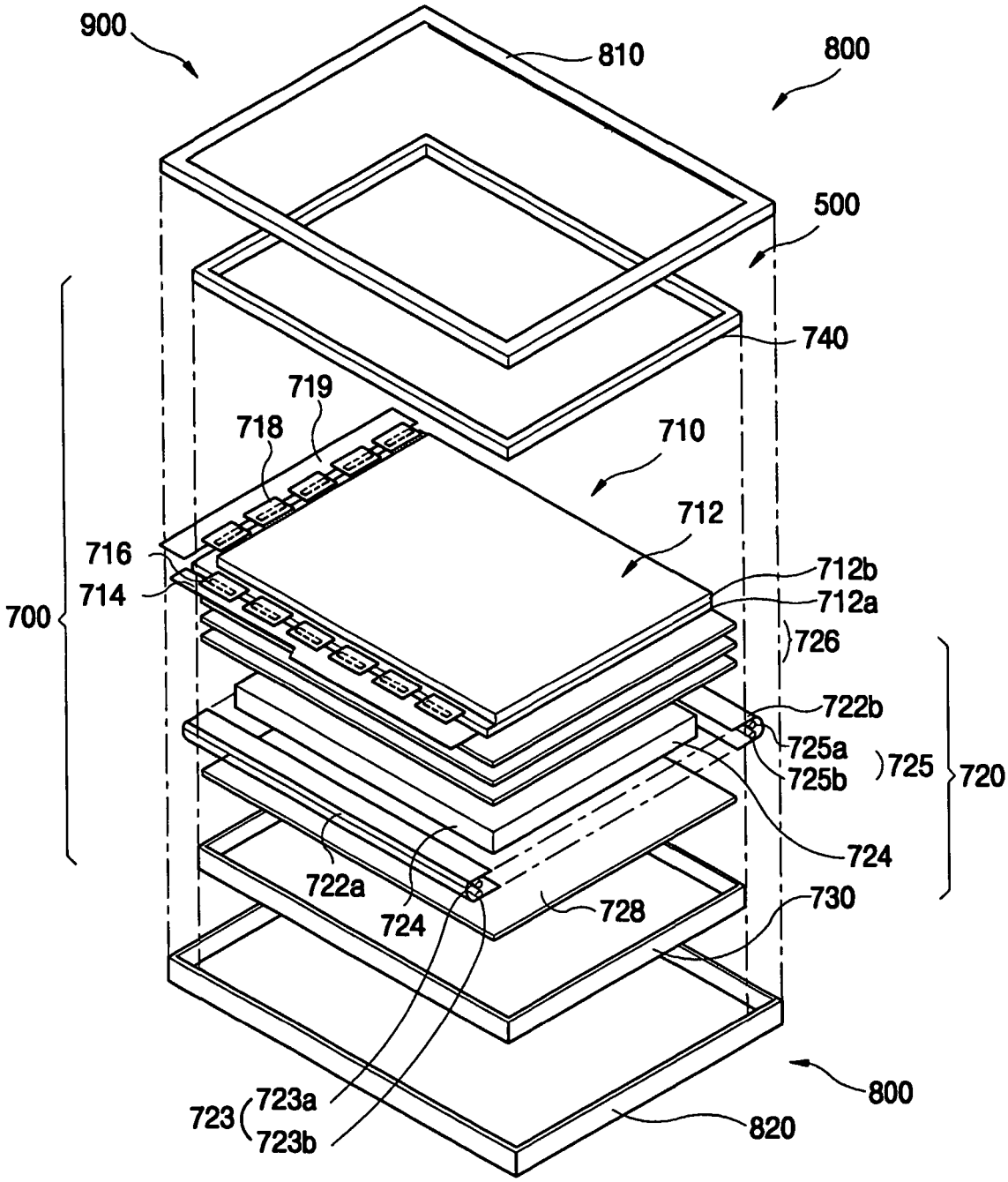
FIG. 4 is an exploded perspective view showing the LCD apparatus according to the present invention.

FIG. 4 is an exploded perspective view showing the LCD apparatus according to the present invention. In FIG. 4, the LCD apparatus has lamps disposed at edge portion of a light guide plate.

Referring to FIG. 4, the LCD apparatus 900 includes an LCD module 700 for receiving an image signal to display an image and front and rear cases 810 and 820 for receiving the LCD module 700. The LCD module 700 includes a display unit 710 having an LCD panel 712 for displaying the image.

The display unit 710 includes an LCD panel 712, a data PCB (Print Circuit Board) 714, a gate PCB 719, a data TCP (Tape Carrier Package) 716 and a gate TCP 718.

The LCD panel 712 includes a TFT (Thin Film Transistor) substrate 712*a*, a color filter substrate 712*b* and a liquid crystal (not shown) interposed between the TFT substrate 712*a* and color filter substrate 712*b*. The TFT substrate 712*a* is a transparent glass substrate on which TFTs are disposed in a matrix configuration. Each of the TFTs includes a source terminal connected to a data line, a gate terminal connected to a gate line and a drain terminal having a pixel electrode made of ITO (Indium Tin Oxide), which is a transparent conductive material.

When an electric signal is applied to the data and gate lines, the source and gate terminals of each the TFTs receive the electric signal through the data and gate lines. By receiving the electric signal, the TFTs are turned on or turned off, so that the drain terminal receives the electric signal needed to form a pixel.

The color filter substrate 712*b* is disposed facing the TFT substrate 712*a*. RGB pixels, which are color pixels for emitting predetermined colors when the light passes therethrough, are formed on the color filter substrate 712*b* through a thin film process. A common electrode made of ITO is disposed on an entire surface of the color filter substrate 712*b*.

When a power is applied to the gate terminal and the source terminal of the TFTs disposed on the TFT substrate 712*a*, the TFTs are turned on so that an electric field is generated between the pixel electrode and the common electrode of the color filter substrate 712*b*. The electric field varies an aligning angle of the liquid crystal injected between the TFT substrate 712*a* and the color filter substrate 712*b*. Accordingly, a light transmittance of the liquid crystal is varied according to the variation of the aligning angle of the liquid crystal, so a desired image may be obtained.

The data TCP 716 is connected to the data line of the LCD panel 712 so as to decide an applying timing of a data driving signal and the gate TCP 718 is connected to the gate line of the LCD panel 712 so as to decide an applying timing of a gate driving signal.

The data PCB 714 for receiving an image signal from an external and applying the data driving signal to the data line is connected to the data TCP 716 and the gate PCB 719 for applying the gate driving signal to the gate line is connected to the gate TCP 718. The data and gate PCBs 714 and 719 receive the image signal from an external information-processing device (not shown), Such as a computer and generate signals for driving the LCD panel 712, such as the gate driving signal, the data driving signal and a plurality of timing signals for timely applying the gate and data driving signals.

The backlight assembly 720 is disposed under the display unit 710 so as to uniformly supply the light to the display unit 710. The backlight assembly 720 includes first and second lamp units 723 and 725, a light guide plate 724, an optical sheet 726 and a reflecting plate 728. The first and second lamp units 723 and 725 include first and second lamps 723*a* and 723*b* and third and fourth lamps 725*a* and 725*b*, respectively. Each of the first and second lamp units 723 and 725 are covered by first and second lamp covers 722*a* and 722*b*.

The light guide plate 724 having a size corresponding to that of the LCD panel 712 of the display unit 710 is disposed under the LCD panel 712 to change an optical path while guiding the light emitted from the first and second lamp units 723 and 725 toward the display unit 710.

In FIG. 5, the light guide plate 724 has a uniform thickness and the first and second lamp units 723 and 725 are disposed adjacent to both end portions of the light guide plate 724 to increase an light efficiency of the light provided to the light guide plate 724. Accordingly, the number of the first to fourth lamps 723*a*, 723*b*, 725*a* and 725*b* may be varied according to on an brightness state of the LCD apparatus 900 in total.

A plurality of optical sheets 726 is disposed on the light guide plate 724 in order to allow the brightness of the light guiding to the LCD panel 712 to be uniform. The reflecting plate 728 is disposed under the light guide plate 724 to reflect the light leaked through a bottom surface of the light guide plate 724 toward the light guide plate 724.

A mold frame 730 is provided under the reflecting plate 728 to receive the display unit 710 and backlight assembly 720. The mold frame 730 provides a receiving space for receiving the display unit 710 and backlight assembly 720. The mold frame 500 has a rectangular parallelepiped box shape and an upper surface thereof is opened.

A chassis 740 is provided on the display unit 710. The chassis 740 is combined with the mold frame 730 to prevent the display unit 710 from being deviated from the mold frame 730. The chassis 7400 is oppositely coupled with the mold frame 730 so as to bend the data and gate PCBs 714 and 719 towards an exterior of the mold frame 730 and fixes the data and gate PCBs 714 and 719 to the rear surface of the mold frame 730. The chassis 740 includes a bottom surface having an opening to expose the LCD panel 710 and a sidewall that covers end portions of the LCD panel 710.

Although not shown in FIG. 1, the LCD apparatus 900 further includes a first inverter INV1 in order to drive the first to fourth lamps 723*a*, 723*b*, 725*a* and 725*b*.

Table 1 shows characteristics of a direct illumination LCD having the CCFL and a direct illumination LCD having the EEFL according to the present invention. In Table 1, the CCFL and EEFL modules are adopted to an LCD panel having a size of 17 inches.

TABLE 1

| | CCFL direct illumination type LCD | EEFL direct illumination type LCD |
|---|---|---|
| Brightness | 450 [nits] | |
| Color coordinates [x, y] | 0.268, 0.306 | 0.288, 0.344 |
| Brightness uniformity | 75 [%] | |
| Panel transmittance | 3.74 [%] | |
| Contrast | 472.3 | 527.3 |
| Power consumption | 31 [watt] | 31 [watt] |
| Driving inverter | Individual driving method 65 [KHz] Ground method | Parallel driving method 65 [KHz] Floating method |

In case of correcting the color coordinates of the EEFL direct illumination type LCD to have the color coordinates same as that of the CCFL direct illumination type LCD, the power consumption of the EEFL direct illumination type LCD increases about 2 watts.

According to Table 1, the EEFL module has a contrast higher than that of the CCFL module and needs a voltage lower than that of the CCFL module in order to have a light efficiency (brightness/power consumption) same as that of the CCFL module. Therefore, the EEFL module may reduce the power consumption of about 30% in comparison with the CCFL module.

Figure 5A:
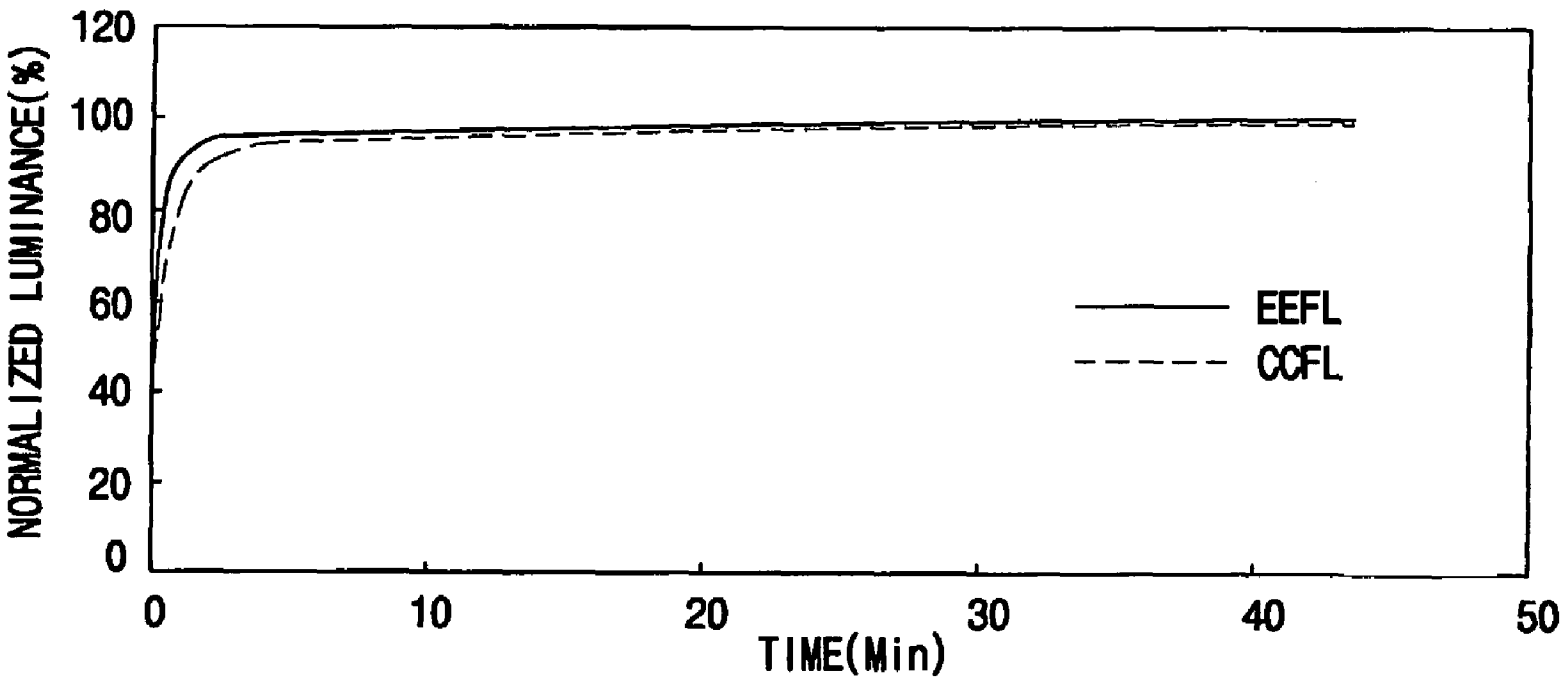
FIGS. 5A and 5B are graphs illustrating brightness characteristics and light efficiency of a backlight assembly having the CCFL and a backlight assembly having the EEFL according to the present invention.
Figure 5B:
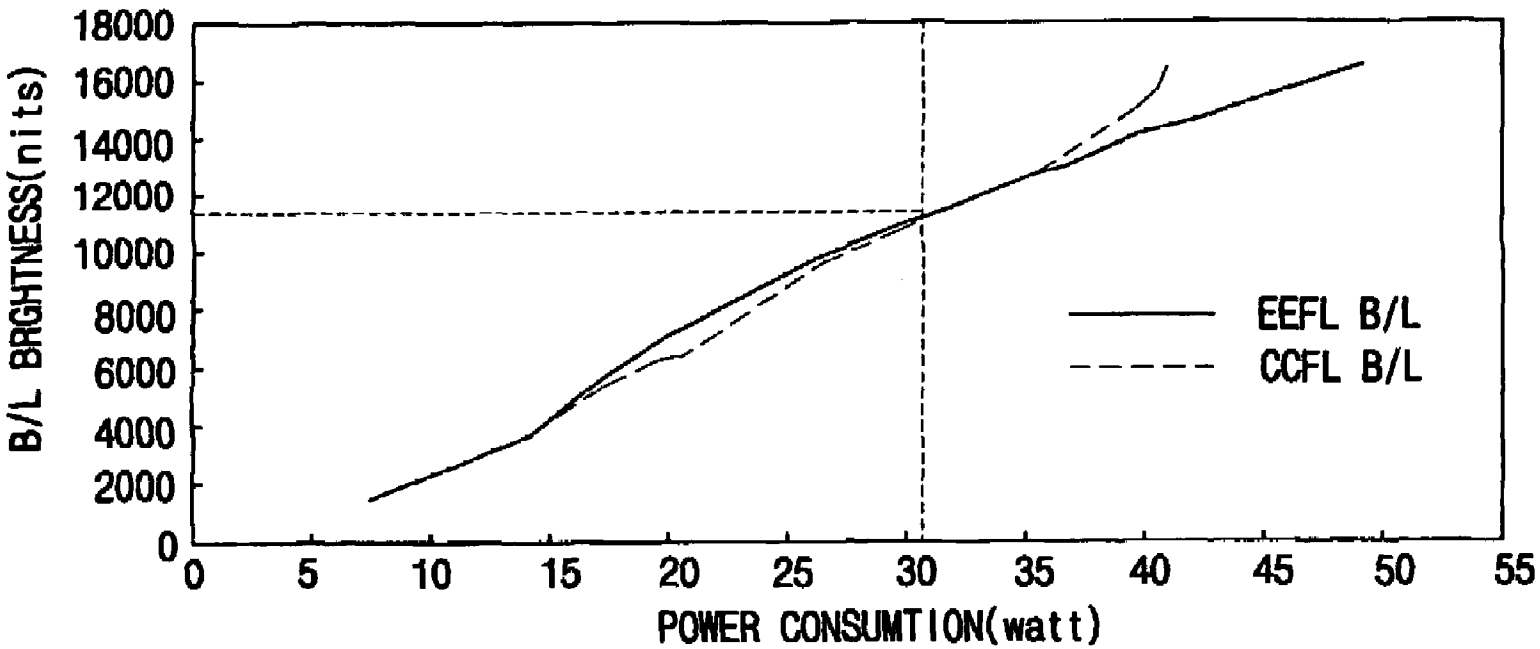

FIGS. 5A and 5B are graphs illustrating brightness characteristics and light efficiency of a backlight assembly having the CCFL and a backlight assembly having the EEFL according to the present invention.

Referring to FIG. 5A, the backlight assembly having the EEFL shows a normalized luminance same as that of the backlight assembly having the CCFL after two or three minutes. At the beginning of the operation, the backlight assembly having the EEFL shows a good brightness characteristic than that of the backlight assembly having the CCFL. That is, the backlight assembly having the EEFL shows a brightness saturation characteristic better than that of the backlight assembly having the CCFL Referring to FIG. 5B, the backlight assembly having the EEFL has the light efficiency approximate to that of the backlight assembly having the CCFL in view of the brightness characteristics with respect to the power consumption.

According to the present invention, the antenna is disposed adjacent to the output terminal of the transformer in order to sense the power applied to the lamp. The lamp driving apparatus may check whether or not the power applied to the lamp is in a normal state based on the power applied to the lamp. Accordingly, the lamp driving apparatus may block an abnormal voltage applied to the lamp and uniformly maintain the level of the power applied to the lamp, thereby obtaining a uniform brightness.

Also, when a voltage having a level higher than that of the reference voltage is applied to the lamp through the output terminal of the transformer, the lamp driving apparatus may lower the level of the input voltage source and when a voltage having a level lower than that of the reference voltage is applied to the lamp, the lamp driving apparatus may boost the level of the input voltage source. Thus, a life of the lamp may be longer because it is able to prevent the lamp from being damaged.

Further, if the lamp is in the abnormal state, the voltage source outputted from the transformer is not sensed by the antenna, so that the lamp driving apparatus may block the voltage source applied to the lamp based on the sensed result by the antenna, thereby preventing the lamp driving apparatus, the inverter, the backlight assembly and the LCD apparatus from being damaged by the voltage source.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed.

The invention claimed is:

1. An apparatus for supplying power comprising:

a switching section for controlling an output of a direct current voltage source inputted from external;

a power transforming section for converting the direct current voltage source from the switching section into an alternating current voltage source and transforming the alternating current voltage source;

a control section for outputting a switching signal so as to control an output of a constant current supplied to a lamp unit in response to a dimming signal inputted from an external;

a sensing section for sensing variation of the alternating current voltage source supplied to the lamp unit, the sensing section wirelessly connected to the power transforming section; and a detecting section for comparing a sensing signal provided from the sensing section with a predetermined reference signal to output a detecting signal to the control section, thereby maintaining the constant current to be supplied to the lamp unit.

2. The apparatus of claim 1, wherein the sensing section senses variations of current and voltage of the alternating current voltage source supplied to both end terminals of the lamp unit.

3. The apparatus of claim 2, wherein the sensing section comprises a coil shape.

4. The apparatus of claim 1, wherein the power transforming section comprises a transformer having a primary winding and a secondary winding, for transforming the alternating current voltage source and the sensing section is disposed adjacent to the secondary winding of the transformer.

5. A backlight assembly comprising:

a lamp driving section for converting a direct current voltage source inputted from an external into an alternating current voltage source and transforming the convened alternating current voltage source;

a light emitting section for emitting a light in response to the transformed alternating current voltage source, the light emitting section having a lamp unit tat receives a high voltage of an alternating current voltage source through at least one end terminal; and a light control section for increasing a brightness of the light, wherein the lamp driving section comprises:

a control section for outputting a switching signal so as to control an output of a constant current supplied to the lamp unit in response to a dimming signal inputted from an external, the control section being operated in response to on and/or off signals from the external;

a switching section for controlling an output of a direct current voltage source in response to the switching signal;

a power outputting section for converting the direct current voltage source from the switching section into the alternating current voltage source, transforming the converted alternating current voltage source into an alternating current voltage source having a constant voltage to provide the alternating current voltage source having the constant voltage to the lamp unit;

a sensing section for sensing variation of the alternating current voltage source supplied to the lamp unit, the sensing section wirelessly connected to the power outputting section; and a detecting section for comparing a sensing signal provided from the sensing section with a predetermined reference signal to output a detecting signal to the control section, thereby maintaining the constant current to be supplied to the lamp unit.

6. The backlight assembly of claim 5, wherein the lamp unit comprises an external electrode fluorescent lamp having two electrodes, at least one electrode of the two electrodes being disposed on outer surface thereof.

7. The backlight assembly of claim 6, wherein the lamp unit comprises a plurality of external electrode fluorescent lamps connected to each other in parallel.

8. The backlight assembly of claim 7, wherein the sensing section is connected to each of the external electrode fluorescent lamps.

9. The backlight assembly of claim 8, wherein the number of the detecting section is equal to that of the sensing section.

10. The backlight assembly of claim 5, wherein the power outputting section comprises a transformer having a primary winding and a secondary winding, for boosting the converted alternating current voltage source and the sensing section senses the sensing signal from the secondary winding of the transformer.

11. The backlight assembly of claim 10, wherein the sensing section comprises a coil shape.

12. The backlight assembly of claim 10, wherein the sensing section is disposed adjacent to the secondary winding of the transformer, senses a voltage based on an electric field induced in response to a power of the secondary winding and provides the sensed voltage to the detecting section.

13. The backlight assembly of claim 5, wherein the power outputting section provides a constant voltage of the transformed alternating current voltage source to both end terminals of the lamp unit, the constant voltage having positive and negative polarity levels equal to each other.

14. The backlight assembly of claim 5, wherein the power outputting section provides a constant voltage of the transformed alternating current voltage source to both end terminals of the lamp unit, the constant voltage having differences between a highest level and a lowest level of the transformed alternating current voltage source equal to each other.

15. The backlight assembly of claim 5, wherein the lamp driving section further comprises a diode having a cathode connected to an output terminal of the switching section and an anode connected to a ground, for blocking a rush current from the power outputting section to the switching section.

16. The backlight assembly of claim 5, wherein the lamp driving section further comprises a switching device driving section for amplifying a signal so as to adjust a level of the alternating current voltage source provided from the control section and providing the amplified signal to the switching section.

17. An LCD apparatus comprising:

a backlight assembly having a lamp driving section for converting a direct current voltage source inputted from an external into an alternating current voltage source and transforming the converted alternating current voltage source; a light emitting section for emitting a light in response to the transformed alternating current voltage source, the light emitting section having a lamp unit that a plurality of external electrode fluorescent lamps are connected to each other in parallel, each of the external electrode fluorescent lamps having at least one electrode that receives a high voltage of an alternating current voltage source; and a light control section for increasing a brightness of the light provided from the light emitting section; and a display unit disposed on the light control section, for receiving the light from the light emitting section through the light control section and displaying an image, wherein the lamp driving section comprises:

a control section for outputting a switching signal so as to control an output of a constant current supplied to the lamp unit in response to a dimming signal inputted form an external, the control section being operated in response to on and/or off signals from the external;

a switching section for controlling an output of a direct current voltage source in response to the switching signal;

a power outputting section for converting the direct current voltage source from the switching section into the alternating current voltage source, transforming the converted alternating current voltage source into an alternating current voltage source having a constant voltage to provide the alternating current voltage source having a constant voltage to the lamp unit;

a sensing section for sensing variation of the alternating current voltage source supplied to the lamp unit, the sensing section wirelessly connected to the power outputting section; and a detecting section for comparing a sensing signal provided from the sensing section with a predetermined reference signal to output a detecting signal to the control section, thereby maintaining the constant current to be supplied to the lamp unit.

* * * * *